United States Patent [19]

Carter

[11] Patent Number: 4,963,936

[45] Date of Patent: Oct. 16, 1990

[54] DEVELOPER UNIT MOUNTING APPARATUS

[75] Inventor: Stephen W. Carter, Rochester, N.Y.

[73] Assignee: Xerox Corporation, Stamford, Conn.

[21] Appl. No.: 446,346

[22] Filed: Dec. 5, 1989

[51] Int. Cl.[5] ..... G03G 15/06; G03G 15/09

[52] U.S. Cl. ..... 355/245; 118/657; 355/251

[58] Field of Search ..... 355/245, 251, 253, 259, 355/260, 326, 327; 206/316; 118/657-658

[56] References Cited

U.S. PATENT DOCUMENTS

| | | | |
|---|---|---|---|
| 3,981,272 | 9/1976 | Smith et al. | 118/637 |
| 4,097,139 | 6/1978 | Hauser et al. | 355/326 |
| 4,203,386 | 5/1980 | Blöchl et al. | 355/245 |
| 4,361,112 | 11/1982 | DiNallo, Sr. et al. | 355/256 |
| 4,565,437 | 1/1986 | Lubinsky | 355/251 |
| 4,803,510 | 2/1989 | Maeda | 355/245 |

*Primary Examiner*—Grimley, A. T.
*Assistant Examiner*—J. E. Barlow, Jr.
*Attorney, Agent, or Firm*—H. Fleischer; J. E. Beck; R. Zibelli

[57] ABSTRACT

A mounting apparatus for a developer unit adapted to develop an electrostatic latent image recorded on a photoconductive member. A support system is mounted pivotably on a frame and slidably supports the developer unit. The support system pivots from an operative position wherein the developer unit is positioned adjacent the photoconductive member to a non-operative position wherein the developer unit is inclined away from the photoconductive member. In the non-operative position, the developer unit may be slidably removed from the printing machine.

5 Claims, 6 Drawing Sheets

DEVELOPER UNIT MOUNTING APPARATUS

This invention relates generally to an electrophotographic printing machine, and more particularly concerns a mounting apparatus for a developer unit adapted to develop a latent image recorded on a photoconductive member.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer material comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

A high speed commercial printing machine of this type frequently uses a magnetic brush development system for developing the latent image. The magnetic brush system generally employs several developer rollers for transporting the developer material closely adjacent to the photoconductive surface. The photoconductive member must be precisely spaced or wrapped with respect to each developer roll in order to achieve acceptable copy quality. Yet the development system must be capable of being removed from the printing machine without scratching the photoconductive member so as to be repaired. Furthermore, the photoconductive member must also be removable from the printing machine for replacement and an unused photoconductive member installed without being scratched or damaged by the developer rolls or the developer material. At present, it is very difficult to remove or replace the developer unit or photoconductive member because of the limited space between the developer unit and the photoconductive member. If not aligned properly, damage to the photoconductive member may result. In addition this also causes developer material to be scraped off the developer roll by the photoconductive member contaminating the photoconductive member module and other printing machine assemblies. One approach for solving this problem has been to use a drive clutch in the developer housing enabling the operator to reverse the direction of rotation of the developer rolls for a short duration. This removes developer material from the region of the photoconductive member. However, it has been found that this action is not sufficient to eliminate the problem. Various other approaches have been devised to facilitate the removal of the developer unit and or photoconductive member from the printing machine. The following disclosures appear to be relevant:

U.S. Pat. No. 3,981,272 Patentee: Smith et al. Issued: Sep. 21, 1976.

U.S. Pat. No. 4,803,510 Patentee: Maeda Issued: Feb. 7, 1989.

The relevant portions of the foregoing disclosures may be briefly summarized as follows:

U.S. Pat. No. 3,981,272 discloses a split housing for a magnetic brush developing apparatus wherein one of the sections of the housing is movable and the other is mounted and fixed within an electrophotographic copying machine. The first section is also attachable to the second section. The movable section is configured so as not to upset the spacing between a development roll and a photoreceptor.

U.S. Pat. No. 4,803,510 describes a copying machine with a removable processing unit containing a developing apparatus located within a housing. The housing is equipped with two spring actuated, rotatably slanted guide plates which, when opened, allow the developer unit to be detached from the copying machine without damage or contaminating the machine's photoconductive drum or a charge induced thereon.

In accordance with one aspect of the present invention, there is provided an apparatus for developing a latent image recorded on a photoconductive member. The apparatus includes a developer unit positioned, in an operative position, adjacent the photoconductive member. Means are provided for supporting the developer unit slidably and pivotably so that the developer unit may be pivoted from the operative position to a non-operative position and be slidably removed from the supporting means.

Pursuant to another aspect of the present invention, there is provided a mounting apparatus for a developer unit adapted to develop an electrostatic latent image recorded on a photoconductive member. The mounting apparatus includes a frame and a support system mounted pivotably thereon. The developer unit is supported slidably by the support system. The support system is adapted to pivot from an operative position wherein the developer unit is positioned adjacent the photoconductive member to a non-operative position wherein the developer unit is inclined away from the photoconductive member so that the developer unit may be slidably removed from the support system.

Still another aspect of the present invention is an electrophotographic printing machine of the type in which an electrostatic latent image recorded on a photoconductive member is developed with a developer material. The improved development apparatus includes a developer unit positioned, in the operative position, adjacent the photoconductive member. Means are provided for supporting the developer unit slidably and pivotably so that the developer unit may be pivoted away from the photoconductive member to a non-operative position and be slidably removed from the supporting means.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
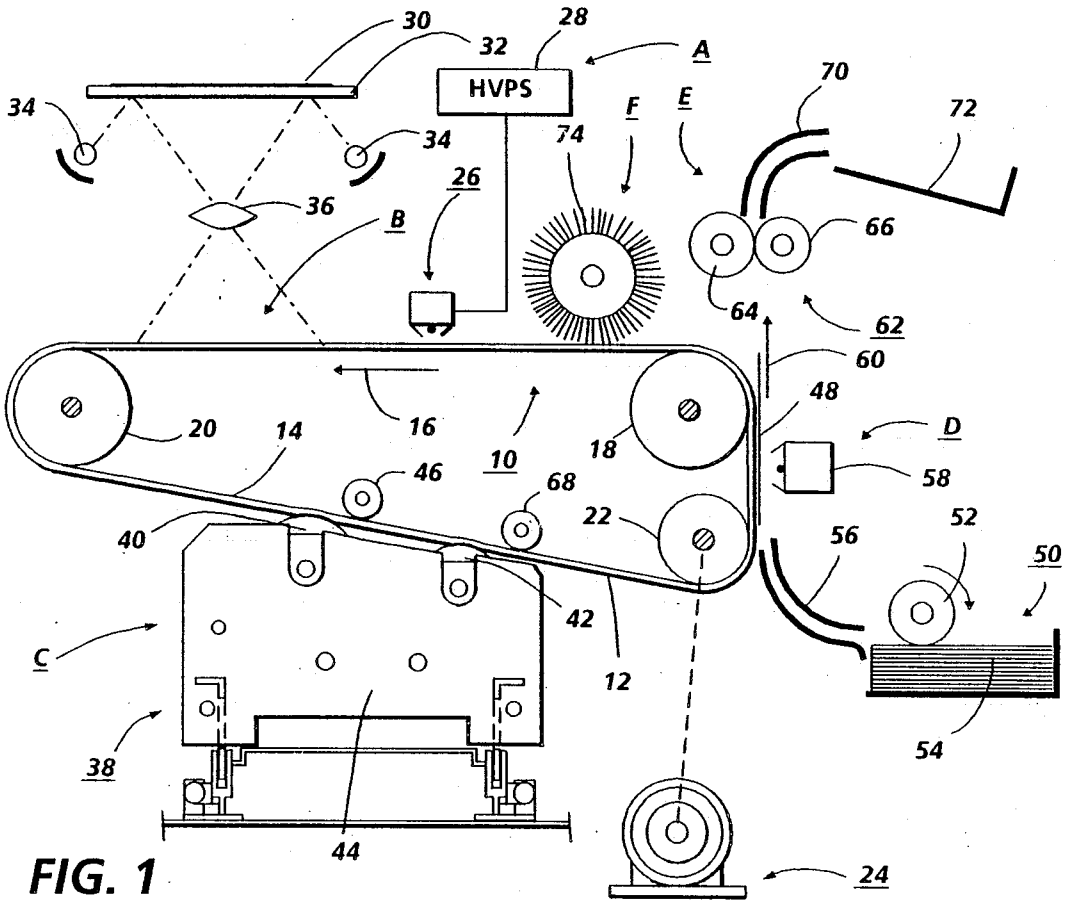
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development mounting apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development unit, indicated generally by the reference numeral 38, advances developer material into contact with the latent image. Preferably, development unit 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. Developer rollers 40 and 42 are mounted, at least partially, in the chamber of developer housing 44. The chamber in developer housing 44 stores a supply of developer material therein. Guide rollers 46 and 68 deflect belt 10 so that a portion of belt 10 is wrapped about a region of the exterior circumferential surface of rollers 40 and 42 to form extended development zones about each of the developer rollers. Developer unit 38 is mounted on the mounting apparatus of the present invention so that the developer unit may be pivoted away from belt 10. This spaces developer rollers 40 and 42 from belt 10. Thereafter, developer unit 38 may be removed from the printing machine by sliding the developer unit forward (out of the plane of the paper) along the mounting apparatus. The detailed structure of the mounting apparatus for developer unit 38 will be described hereinafter with reference to FIGS. 2 through 5, inclusive.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development system of the present invention therein.

Figure 2:
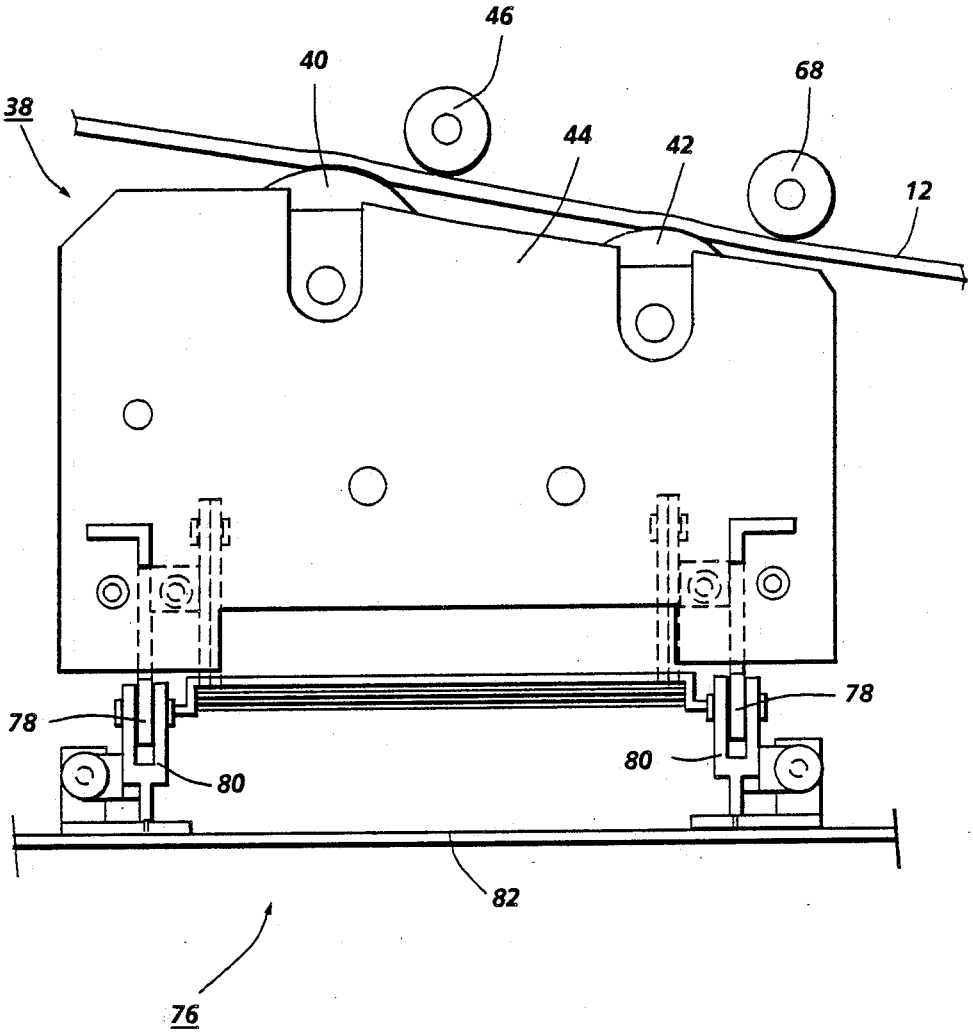
FIG. 2 is a front elevational showing the mounting apparatus supporting the developer unit used in the FIG. 1 printing machine in the operative position.
Figure 3:
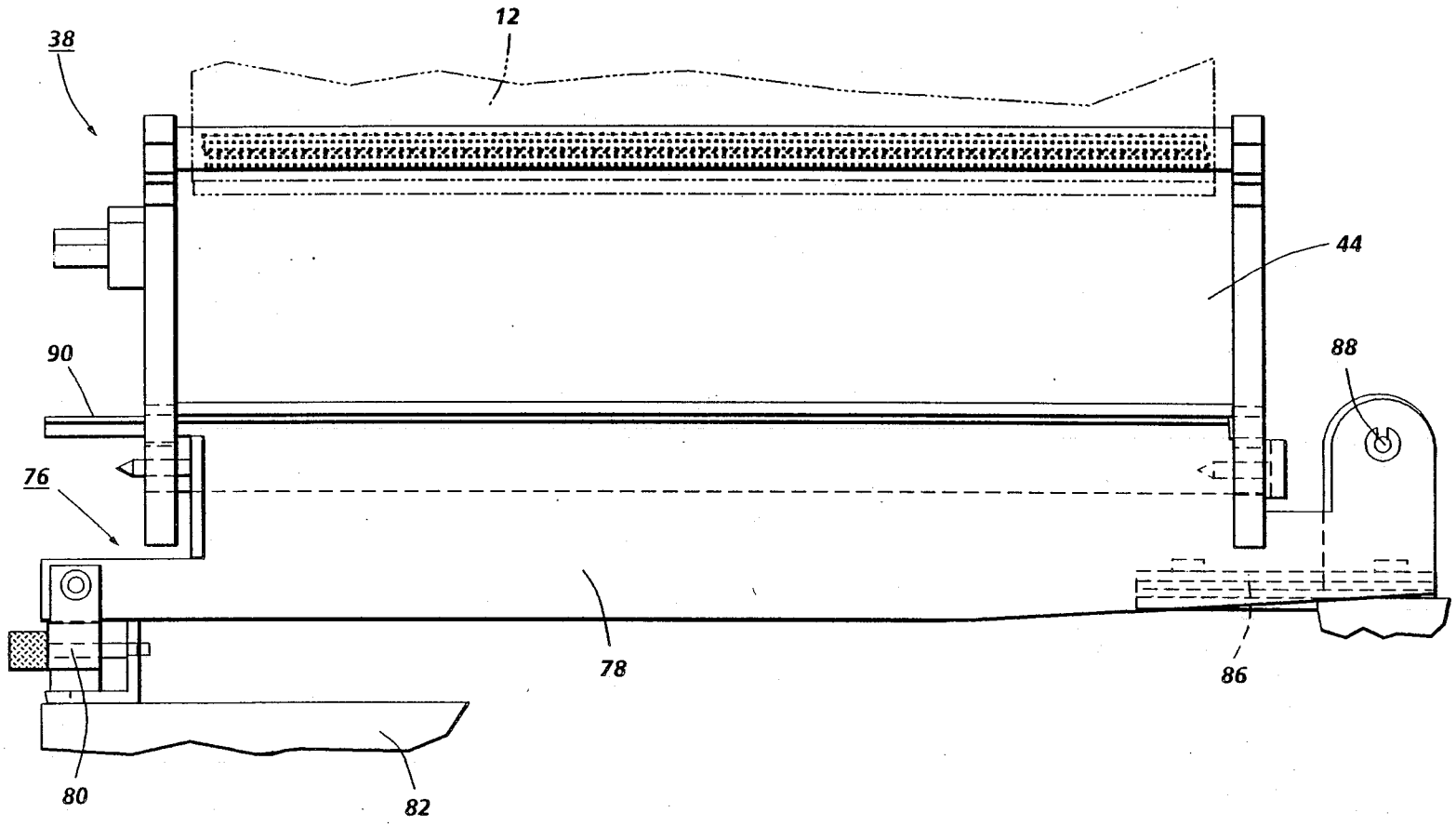
FIG. 3 is a side elevational view showing the mounting apparatus supporting the developer unit used in the FIG. 1 printing machine in the operative position.

Referring now to FIGS. 2 and 3, there is shown the mounting apparatus, indicated generally by the reference numeral 76, for developer unit 38. As shown thereat, mounting apparatus 76 is supports developer unit 38 in the operative position with developer rollers 40 and 42 being adjacent belt 10. Mounting apparatus 76 includes a pair of rails 78 supporting developer unit 38 slidably. The rear ends of rails 78 are mounted pivotably on the printing machine frame. Brackets 80 are mounted rotatably on the front ends of rails 78. In the operative position, brackets 80 are upright and engage frame 82 of the printing machine. In this orientation, rails 78 are substantially horizontal and developer unit 38 is in the operative position with belt 10 engaging developer rollers 40 and 42. In order to remove developer unit from the printing machine, brackets 80 are rotated so that rails 78 pivot about the rear ends in a downwardly direction so as to be inclined. This pivots developer unit 38 away from belt 10 to the non-operative position as shown in FIG. 4.

Figure 4:
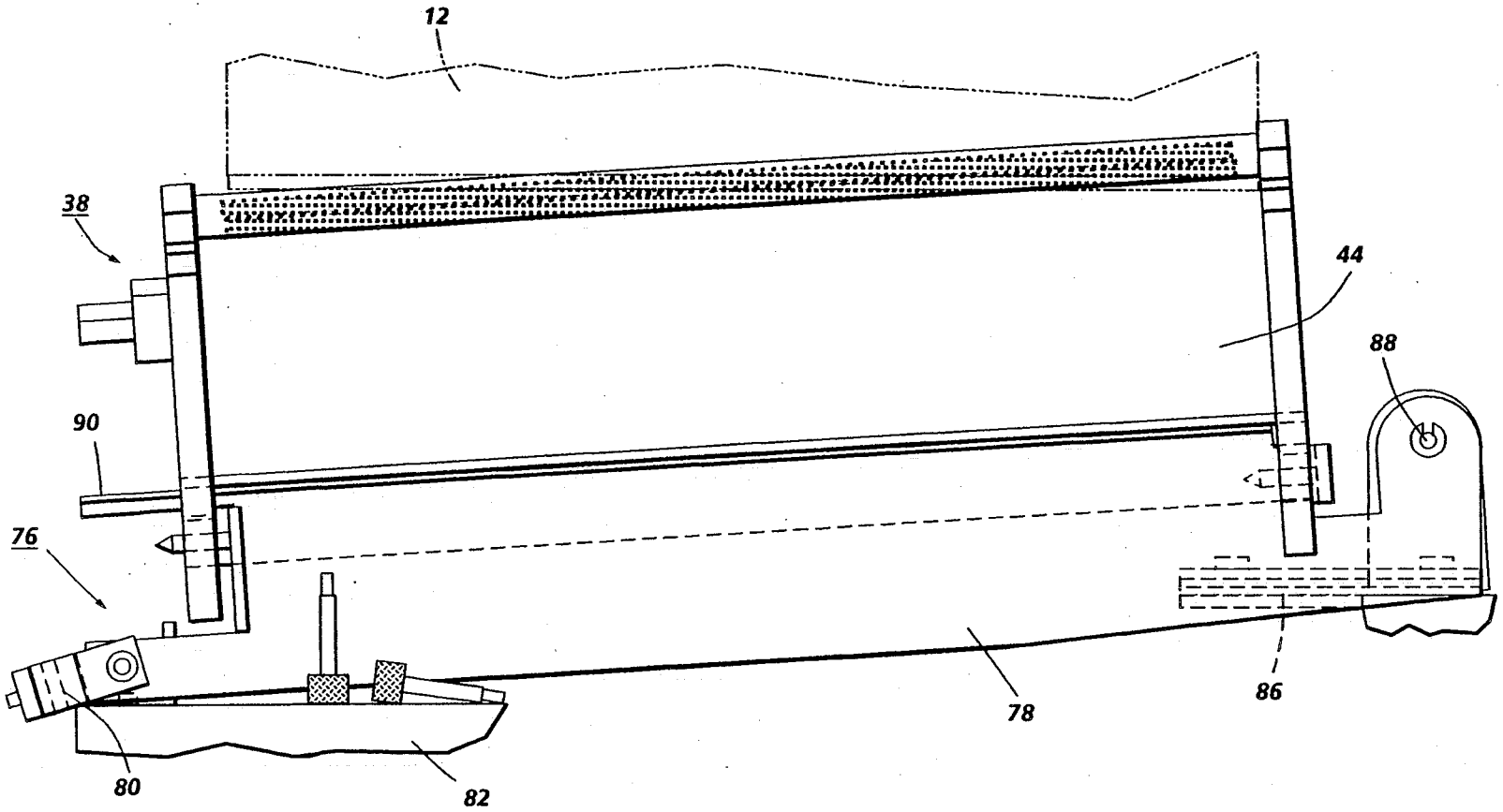
FIG. 4 is a side elevational view showing the mounting apparatus supporting the developer unit used in the FIG. 1 printing machine in the non-operative position.

Turning now to FIG. 4, there is depicted mounting apparatus 76 supporting developer unit 38 in the non-operative position. Brackets 80 are rotated so that rails 78 pivot in a downwardly direction. This positions rails 78 at a transverse angle relative to a horizontal plane, i.e. on an incline,-which facilitates the removal of developer unit 38 from the printing machine by sliding the developer unit along the rails. In this position, the developer rollers of the developer unit are spaced from the photoconductive belt as the developer unit is removed. This insures that the photoconductive belt is not damaged in any manner by the removal of the developer unit from the printing machine. In addition, when the brackets have been rotated to position the developer unit in the non-operative position, the photoconductive belt may be removed from the printing machine without the developer rollers intefering therewith. The brackets pivot downwardly form an upright position to a horizontal position in pivoting the rails from a horizontal position to an inclined position. This is achieved by having one end of the brackets pivot about the front end of the rails and the other end of the brackets pivot about the frame so that the brackets pivot from a vertical position to a horizontal position. After the brackets are positioned in the horizontal position and the rails inclined, developer unit 38 is removed by sliding it away from the photoconductive belt, as shown in FIG. 5.

Figure 5:
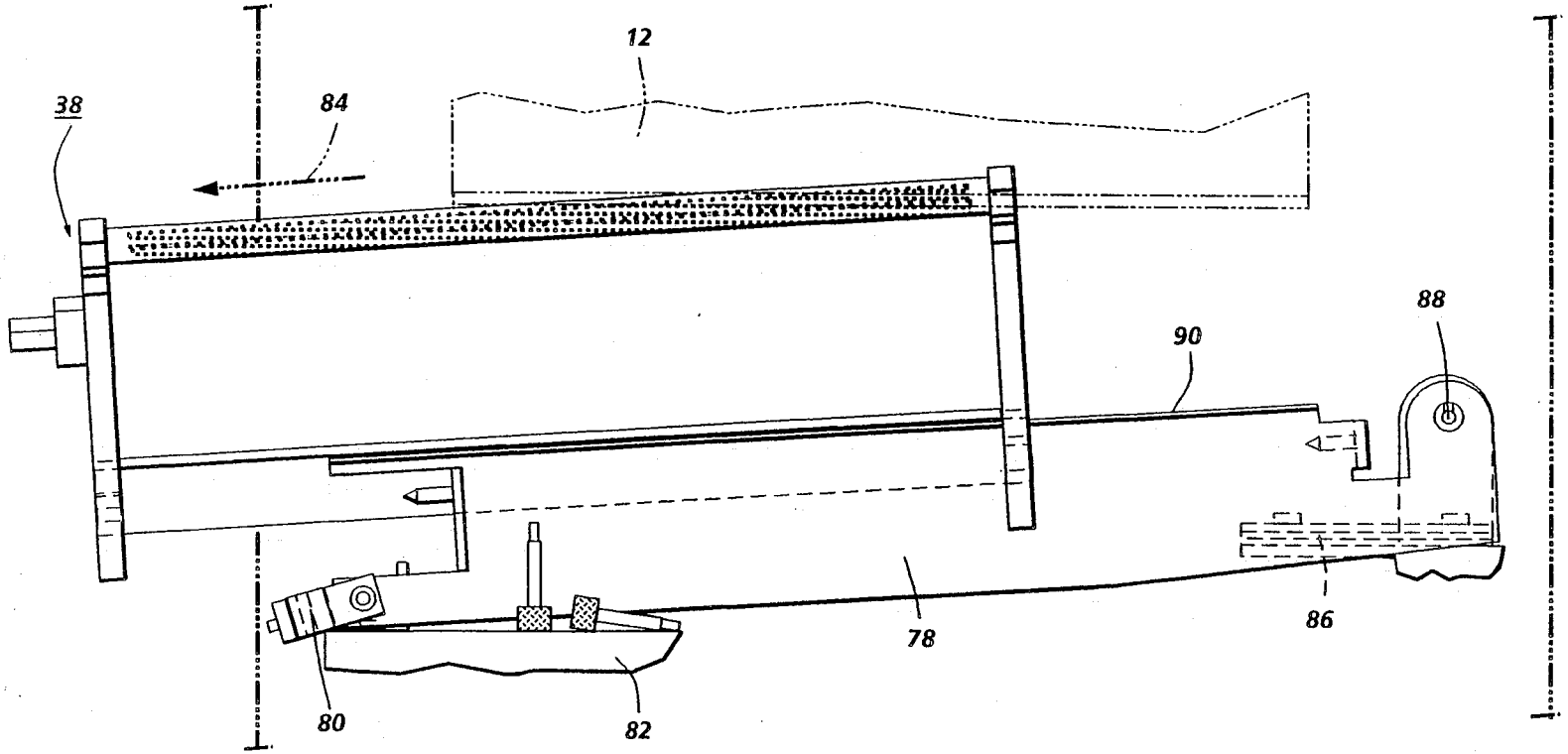
FIG. 5 is a side elevational view illustrating the developer unit being removed from the printing machine.
Figure 6:
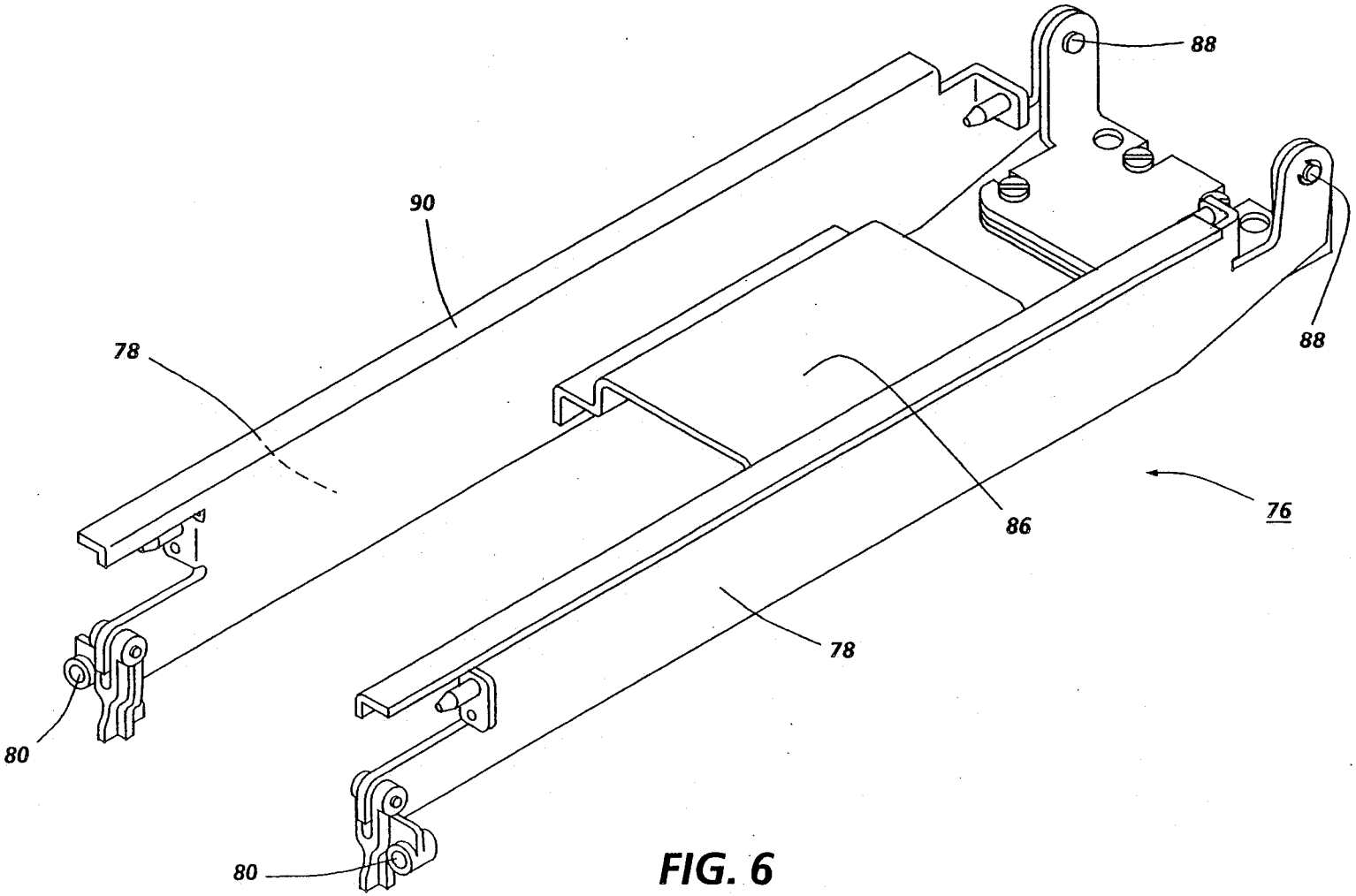
FIG. 6 is a perspective view of the mounting apparatus used to support the developer unit.

FIG. 5 illustrates developer unit 38 partially removed from the printing machine. As depicted thereat, developer unit 38 is moved in the direction of arrow 84 downwardly along the inclined rails away from frame 82. As the developer unit slides in the direction of arrow 84 along the rails, it leaves the printing machine without the developer rollers contacting the photoconductive belt. This insures that the photoconductive belt is not damaged during the removal of the developer unit from the printing machine. Mounting apparatus 76 is shown in greater detail in FIG. 6.

FIG. 5 is a perspective view of the mounting apparatus. As shown thereat, mounting apparatus 76 has a pair of spaced rails 78. Rails 78 are spaced from one another and secured to one another by cross piece 86. Ends 88 of rails 78 are pivotably attached to the frame 82 of the printing machine. Pins pivotably secure rear ends 88 of rails 78 to frame 82. Surfaces 88 of rails 78 are planar for supporting developer unit 38 thereon. Brackets 80 are pivotably attached to the front ends of rails 78. Pins attach brackets 80 to the front ends of rails 78. By way of example, rails 78 may be made from a suitable sheet metal with brackets 80 being made from any suitable metal or plastic material. When brackets 80 are in the upright or vertical position, as shown in FIG. 5, the lowermost portions thereof contact frame 82 to support rails 78 with surfaces 90 in a substantially horizontal plane. When brackets 80 rotate to a horizontal position, rails 78 pivot about the pins attaching rear end 88 to frame 82 to position surfaces 90 on an incline. When surface 90 is inclined, developer unit 38 may be slidably removed from mounting apparatus 76 and the printing machine without damaging the photoconductive belt.

In recapitulation, it is evident that mounting apparatus of the present invention has rails which support the developer unit in an operative position with the developer rollers adjacent the photoconductive belt. The rails pivot downwardly from a horizontal position to an inclined position. When the rails are in the inclined position, the developer unit is in the non-operative position with the developer rollers spaced from the photoconductive belt. In the non-operative position, the developer unit may be slidably removed from the printing machine, or the photoconductive belt removed from the printing machine. In either case, the photoconductive belt is spaced from the developer rollers and undamaged during the removal of the developer unit from the printing machine, or the removal and installation of the photoconductive belt from the printing machine.

It is, therefore, apparent that there has been provided in accordance with the present invention, a mounting apparatus for a developer unit that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a photoconductive member, including:

a developer unit positioned, in an operative position, adjacent the photoconductive member; and means for supporting said developer unit slidably and pivotably so that said developer unit may be pivoted from the operative position to a non-operative position and be slidably removed from said supporting means, said supporting means includes a frame, a pair of rails spaced from one another for supporting said developer unit and having one end thereof mounted pivotably on said frame, and a support bracket mounted rotatably on the other end of each of said pair of rails and supporting the other end of said pair of rails on said frame, said support bracket being adapted to rotate from a first position maintaining said pair of rails substantially horizontal when said developer unit is positioned in the operative position to a second position maintaining said pair of rails in an inclined position when said developer unit is in the non-operative position.

2. An apparatus according to claim 1, wherein said developer unit includes:

a housing, mounted slidably on said pair of rails, defining a chamber for storing a supply of developer material; and at least two developer rollers mounted, in the chamber of said housing for transporting developer material to the photoconductive member to develop the latent image recorded thereon with each of said developer rollers being closely adjacent the photoconductive member when said developer unit is positioned in the operative position and being spaced from the photoconductive member when said developer unit is in the non-operative position.

3. A mounting apparatus for a developer unit adapted to develop an electrostatic latent image recorded on a photoconductive member, including:

a frame; and a support system mounted pivotably on said frame and adapted to support slidably the developer unit, said support system pivoting from an operative position wherein the developer unit is positioned adjacent the photoconductive member to a non-operative position wherein the developer unit is inclined away from the photoconductive member so that the developer unit may be slidably removed from said support system said support system includes a pair of rails spaced from one another for supporting said developer unit and having one end thereof mounted pivotably on said frame, and a support bracket mounted rotatably on the other end of each of said pair of rails and supporting the other end of said pair of rails on said frame, said support bracket being adapted to rotate from a first position maintaining said pair of rails substantially horizontal when the developer unit is positioned in the operative position to a second position maintaining said pair of rails in an inclined position when the developer unit is in the non-operative position.

4. An electrophotographic printing machine of the type in which an electrostatic latent image recorded on a photoconductive member is developed with a developer material, wherein the improved development apparatus includes:

a developer unit positioned, in the operative position, adjacent the photoconductive member; and means for supporting said developer unit slidably and pivotably so that said developer unit may be pivoted away from the photoconductive member to a non-operative position and be slidably removed from said supporting means, said supporting means includes a frame, a pair of rails spaced from one another for supporting said developer unit and having one end thereof mounted pivotably on said frame, and a support bracket mounted rotatably on the other end of each of said pair of rails, said support bracket being adapted to rotate from a first position maintaining said pair of rails substantially horizontal when said developer unit is positioned in the operative position to a second position maintaining said pair of rails in an inclined position when said developer unit is in the non-operative position.

5. A printing machine according to claim 4, wherein said developer unit includes:

a housing, mounted slidably on said pair of rails, defining a chamber for storing a supply of developer material; and at least two developer rollers mounted, in the chamber of said housing for transporting developer material to the photoconductive member to develop the electrostatic latent image recorded thereon with each of said developer rollers being closely adjacent the photoconductive member when said developer unit is positioned in the operative position and being spaced from the photoconductive member when said developer unit is in the non-operative position.

* * * * *